United States Patent [19]

Katoh

[11] 4,220,703

[45] Sep. 2, 1980

[54] PHOTOGRAPHIC RECEIVING LAYER WITH ACID PROCESSED GELATIN

[75] Inventor: Kazunobu Katoh, Minami-ashigara, Japan

[73] Assignee: Fuji Photo Film Co., Ltd., Minami-ashigara, Japan

[21] Appl. No.: 24,331

[22] Filed: Mar. 27, 1979

[30] Foreign Application Priority Data

Mar. 28, 1978 [JP] Japan ..... 53/35755

[51] Int. Cl.[2] ..... G03C 1/40; G03C 5/54; B44D 1/09

[52] U.S. Cl. ..... 430/213; 428/500; 430/941

[58] Field of Search ..... 96/29 D, 77, 84 A, 114, 96/114.7, 119 R; 428/474, 500; 101/464; 260/8

[56] References Cited

U.S. PATENT DOCUMENTS

| | | | |
|---|---|---|---|
| 3,709,690 | 1/1973 | Cohen et al. | 96/77 |
| 3,898,088 | 8/1975 | Cohen et al. | 96/77 |
| 3,958,995 | 5/1976 | Campbell et al. | 96/77 |

OTHER PUBLICATIONS

Glafkides, *Photographic Chemistry,* vol. one, Fountain Press, London, 1958, pp. 293–294.

*Primary Examiner*—Richard L. Schilling
*Attorney, Agent, or Firm*—Sughrue, Rothwell, Mion, Zinn and Macpeak

[57] ABSTRACT

A photographic element comprising a support having thereon at least one layer containing acid processed gelatin and a polymeric mordant containing a repeating unit represented by the following general formula (I):

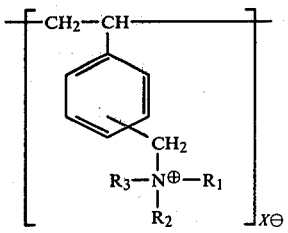

(I)

wherein $R_1$, $R_2$ and $R_3$, which may be the same or different, each represents an alkyl group and the total number of carbon atoms in $R_1$, $R_2$ and $R_3$ is 12 or more; and $X^{\ominus}$ represents an anion.

14 Claims, No Drawings

PHOTOGRAPHIC RECEIVING LAYER WITH ACID PROCESSED GELATIN

BACKGROUND OF THE INVENTION

1. Field of the Invention

The present invention relates to a photographic element containing a mordanting layer suitable for mordanting a dye used in a photographic system and in particular a photographic system for the diffusion transfer process.

2. Description of the Prior Art

It is well known in the photographic field to use various polymeric compounds as mordants to prevent the migration of dyes and some water-insoluble polymeric mordants which show an excellent mordanting effect for dyes are described in U.S. Pat. No. 3,898,088. Further, these polymeric mordants can be used in combination with polyvinyl acetates, cellulose acetate butyrate, gelatin, polyvinyl alcohol, etc., as described in Japanese Patent Application (OPI) 61228/1975 (corresponding to U.S. Pat. No. 3,898,088) (The term "OPI" as used herein refers to a "published unexamined Japanese patent application"). These water-insoluble mordants are dissolved together with other hydrophilic binders in a solvent mixture of water and an organic solvent which is miscible with water and coated to form a layer. However, these known mordanting layers have some defects. That is, it has been found that when the mordanting layers are wetted with an aqueous photographic processing solution, they become cloudy and the images are undesirably damaged and that upon mordanting the dyes, undesirable turbidity sometimes results due to the reaction of the dyes with the mordants.

SUMMARY OF THE INVENTION

A principal object of the present invention is to provide a mordanting layer having improved properties.

Another object of the present invention is to provide a mordanting layer which becomes cloudy to a lesser extent when the layer is wetted with an aqueous photographic processing solution than conventional mordanting layers.

Still a further object of this invention is to provide a mordanting layer which is subject to less haze and which provides a superior image a short time after processing.

A further object of the present invention is to provide an integral type photographic element for color diffusion transfer process comprising a support having coated thereon a mordanting layer having excellent mordanting characteristics and at least one light-sensitive silver halide emulsion layer which is associated with a dye image-providing material.

The above-described objects of the present invention are accomplished using a mordanting layer containing acid processed gelatin and a polymeric mordant containing a repeating unit represented by the following formula (I):

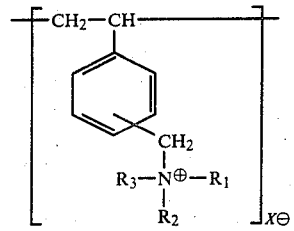

(I)

wherein $R_1$, $R_2$ and $R_3$, which may be the same or different, each represents an alkyl group and the total number of carbon atoms in $R_1$, $R_2$ and $R_3$ is 12 or more; and $X^{\ominus}$ represents an anion.

DETAILED DESCRIPTION OF THE INVENTION

The alkyl group represented by $R_1$, $R_2$ and $R_3$ described above is preferably a straight chain or branched chain alkyl group having 1 to about 20 carbon atoms, for example, a methyl group, an ethyl group, a propyl group, an isopropyl group, a butyl group, a pentyl group, a hexyl group, a benzyl group, an octyl group or a decyl group, etc. The total number of carbon atoms in $R_1$, $R_2$ plus $R_3$ is 12 to 60, preferably 12 to 24. Furthermore, two of $R_1$, $R_2$ and $R_3$ can combine to form a heterocyclic ring with nitrogen atom, preferably a 5- or 6-membered ring, for example, a piperidinyl ring.

Specific examples of combinations of $R_1$, $R_2$ and $R_3$ are as follows:

| | $R_1$ | $R_2$ | $R_3$ |
|---|---|---|---|
| 1. | $C_4H_9$ | $C_4H_9$ | $C_4H_9$ |
| 2. | $C_5H_{11}$ | $C_5H_{11}$ | $C_5H_{11}$ |
| 3. | $C_6H_{13}$ | $C_6H_{13}$ | $C_6H_{13}$ |
| 4. | $C_8H_{17}$ | $C_8H_{17}$ | $C_8H_{17}$ |
| 5. | $C_2H_5$ | $C_2H_5$ | $C_{12}H_{25}$ |
| 6. | $CH_3$ | $CH_3$ | $C_{12}H_{25}$ |

Of the above examples, the case wherein each of $R_1$, $R_2$ and $R_3$ is $C_5H_{11}$ (straight or branched chain) is preferred and the case wherein each of $R_1$, $R_2$ and $R_3$ is $C_6H_{13}$ (straight or branched chain) is particularly preferred with straight chain $C_5H_{11}$ and $C_6H_{13}$ being preferred.

The anion represented by $X^{\ominus}$ in the above formula is preferably a mono- or a divalent anion. Examples of anions represented by $X^{\ominus}$ in the above formula are a halogen ion (e.g., a chlorine ion, a bromine ion, an iodine ion, etc.), a sulfate ion, an alkyl sulfate ion (e.g., a methyl sulfate ion, an ethyl sulfate ion, etc.), an alkyl or aryl sulfonate ion (e.g., a methane sulfonate ion, an ethane sulfonate ion, a benzene sulfonate ion, a para-toluene sulfonate ion, etc.), etc.

The polymeric mordant used in the present invention may be a homopolymer consisting of repeating units of the above formula or a copolymer thereof with another hydrophobic monomer copolymerizable therewith. In a preferred embodiment, more than $\frac{1}{4}$ of the repeating units of the copolymer comprise repeating units of the formula described above. A homopolymer is particularly preferred.

Typical hydrophobic monomers which can be used to form copolymers according to the present invention include ethylene, propylene, 1-butene, isobutene, 2-methylpentene, 2-methylbutene, 1,1,4,4-tetramethylbutadiene, styrene, α-methylstyrene, monoethylenically unsaturated esters of aliphatic acids (e.g., vinyl acetate, isopropenyl acetate, allyl acetate, etc.), ethylenically unsaturated mono- or dicarboxylic acid esters (e.g., methyl acrylate, methyl methacrylate, ethyl acrylate, diethyl methylenemalonate, etc.), monoethylenically unsaturated compounds (e.g., acrylonitrile, allyl cyanate, etc.) and dienes (e.g., butadiene, isoprene, etc.). A preferred group of the hydrophobic monomers which can be used to form the copolymers according to the present invention include styrene, methyl methacrylate, etc.

The term "water-insoluble" used herein means that 1 g or less polymer is soluble in 100 ml of water at 25° C.

A suitable weight average molecular weight for the polymeric mordant is about 5,000 to about 200,000, preferably 10,000 to 50,000.

Acid processed gelatin has a high isoelectric point (about 6.0 to 9.3) in comparison with lime processed gelatin (about 4.8 to 5.1) as described in T. H. James, *The Theory of The Photographic Process,* 4th Edition, p. 55, Macmillan Publishing Co., Inc. (1977) and A. Veis, *The Macromolecular Chemistry of Gelatin,* pp. 99 to 113, Academic Press (1964). Preferably the acid processed gelatin used in the present invention has an isoelectric point of about 6.5 to 7.5.

The acid processed gelatin used in the present invention is a gelatin which is produced by treatment of any collagenous stock with hydrochloric acid, etc., and is different from lime processed gelatin which is conventionally used in the photographic industry and produced by processing of any collagenous stock with lime. Processes for producing such gelatin and the properties thereof have been described in detail in Arthur Veis, *The Macromolecular Chemistry of Gelatin,* pp. 187–217, Academic Press (1964). The greatest difference in these gelatins is the difference in their isoelectric points as pointed out above. Acid processed gelatin can be prepared by analogy to the process disclosed at *Veis,* p. 100.

Examples of the polymeric mordants used in the present invention are shown below, however, the present invention is not limited to the use of these polymers.

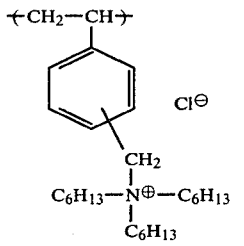

(1)

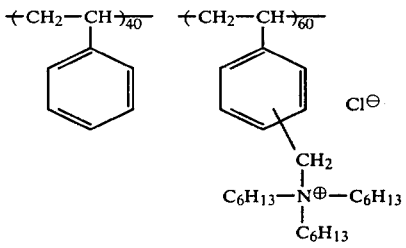

(2)

-continued

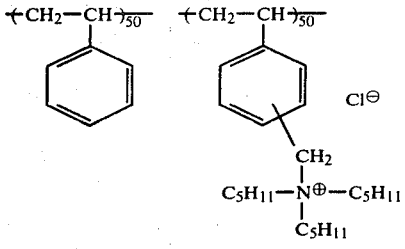

(3)

The polymeric mordants used in the present invention can be prepared by polymerizing a quaternary ammonium salt monomer having the following formula (II):

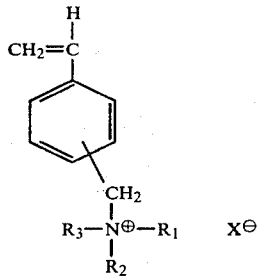

(II)

wherein $R_1$, $R_2$, $R_3$ and $X^{\ominus}$ each has the same meaning as in the formula (I); or by copolymerizing a quaternary ammonium salt monomer of the formula (II) with one or more of the ethylenically unsaturated hydrophobic monomers described above. The polymerization reaction is carried out using a polar solvent (for example, acetone, ethanol, methyl Cellosolve (i.e., β-hydroxyethyl methyl ether)) and a catalyst (for example, azobisisobutyronitrile) at a temperature of 40° to 90° C. under atmospheric pressure or super atmospheric pressure.

Furthermore, the polymeric mordants used in the present invention can be prepared by quaternizing a polymer containing repeating units of the formula (III):

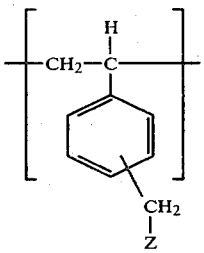

(III)

wherein Z represents a halogen atom; with a tertiary amine having the formula (IV):

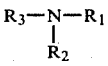

(IV)

wherein $R_1$, $R_2$ and $R_3$ each has the same meaning as in the general formula (I) above.

The novel mordanting layer of the present invention is suitable for use in the color diffusion transfer process.

The mixing ratio and the coating amount of the polymeric mordant and acid processed gelatin according to the present invention can be readily determined depending on the amount of the dyes to be mordanted, the kind and composition of the polymeric mordant, and the image forming process employed; but the amount of the polymeric mordant is preferably 20 to 80% by weight based on the weight of the mordanting layer and the coverage of the polymeric mordant is preferably 0.5 to 8 g/m$^2$. A weight ratio of polymeric mordant/gelatin is about $\frac{1}{4}$ to 4/1, preferably about $\frac{1}{2}$ to 2/1.

The mordanting layer of this invention can be coated as a solution in a mixed solvent of water-ethanol, water-acetone, water-acetone-ethanol, etc., and dried.

The mordanting layer of the present invention can contain a hardening agent. Hardening agents which do not have an anionic dissociating group such as formaldehyde are preferred.

Two or more polymeric mordants of the present invention can be used together in a single layer or in two or more layers. Also, the polymeric mordants of the present invention can be used in admixture with other mordants in the same layer or in separate layers of the same element. Polymeric mordants used in a conventional polymeric mordanting layer (for example, polymeric mordants described in U.S. Pat. Nos. 3,770,439 and 3,898,088) can be used in combination with the mordant of the present invention.

Other materials which can be used in the color diffusion transfer photographic process in accordance with this invention are explained below.

The silver halide emulsion used in this invention is a dispersion in a hydrophilic colloid of silver chloride, silver bromide, silver chlorobromide, silver iodobromide, silver chloroiodobromide, or a mixture thereof and the halogen composition of the silver halide is selected depending on the end-use of the photographic materials and the processing conditions for the photographic materials but a silver iodobromide emulsion or a silver chloroiodobromide emulsion containing up to about 10 mol% iodide (the content of chloride being less than about 30 mol%), and the remainder of the silver halide being bromide is particularly preferred. The grain size of the silver halide used may be an ordinary grain size or a fine grain size but silver halide grains having a mean grain size of from about 0.1 micron to about 2 microns are preferably used. A silver halide emulsion having a uniform grain size is preferably used depending on the end-use of the photographic materials. Furthermore, the crystal form of the silver halide grains used may be that of a cubic system, an octahedral system, or a mixed crystal system of these systems. These silver halide emulsions can be prepared by conventional methods as described in, for example, P. Glafkides, *Chimie Photographique,* 2nd Edition, Chapters 18–23, Paul Montel, Paris (1957).

It is desirable for the silver halide emulsions used in this invention to be chemically sensitized by a heat treatment using the natural sensitizers contained in gelatin; a sulfur sensitizer such as sodium thiosulfate and N,N,N'-triethylthiourea; a gold sensitizer such as a thiocyanate complex salt of monovalent gold and a thiosulfate complex salt of monovalent gold; or a reductive sensitizer such as stannous chloride and hexamethylenetetramine.

Silver halide emulsions capable of readily forming latent images on the surface of the grains can be used in this invention, but it is preferred to use direct reversal silver halide emulsions of the internal latent image forming type as described in U.S. Pat. Nos. 2,497,875, 2,588,962, 2,456,953, 3,761,276, 3,206,313, 3,317,332, 3,761,266, 3,850,637, 3,923,513, 3,736,140, 3,761,267 and 3,854,949.

The silver halide emulsions used in this invention can be stabilized using conventional stabilizers. Furthermore, the silver halide emulsions used in this invention may further contain a sensitizing compound such as a polypropylene oxide compound.

Moreover, the silver halide emulsions used in this invention may be, if desired, spectrally sensitized. Examples of useful spectral sensitizers are cyanines, merocyanines, holopolarcyanines, styryls, hemicyanines, oxanoles, hemioxanoles, etc. Specific examples of spectral sensitizers which can be used in this invention are described in, for example, P. Glafkides, *Chimie Photographique,* 2nd Edition, Chapters 35–41, Paul Montel, Paris (1957) and F. M. Hamer, *Cyanine Dyes and Related Compounds,* Interscience Publications. In these spectral sensitizers, the cyanines in which the nitrogen atom of the basic heterocyclic nucleus is substituted with an aliphatic group (e.g., an alkyl group) having a hydroxyl group, a carboxyl group, or a sulfo group, for example, as described in U.S. Pat. Nos. 2,503,776, 3,459,553 and 3,177,210, are particularly useful for the practice of this invention.

Dye image-providing materials for the diffusion transfer process used together with the above-described silver halide photographic emulsions in this invention are described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,928,312, 3,993,638, 4,076,529, 3,942,987, 3,932,380, 4,055,428, 3,931,144 and 3,932,381, British Patents 840,731, 904,364 and 1,038,331, West German Patent Application (OLS) Nos. 1,930,215, 2,214,381, 2,228,361, 2,242,762, 2,317,134, 2,402,900, 2,406,626 and 2,406,653, and Japanese Patent Application (OPI) Nos. 104,343/76 (corresponding to West German Patent Application (OLS) No. 2,505,248), 8827/77 (corresponding to U.S. patent application Ser. No. 704,603, filed on July 12, 1976), 106727/77 (corresponding to U.S. patent application Ser. No. 774,173, filed on Mar. 3, 1977), 114930/76 and 23628/75, Japanese Patent Applications 58318/77, 64533/77 (corresponding to U.S. patent application Ser. No. 911,571, filed on June 1, 1978), 74601/77 (corresponding to U.S. patent application Ser. No. 917,759, filed on June 21, 1978), and 131278/77 (corresponding to U.S. patent application Ser. No. 956,698, filed on Nov. 1, 1978). Of these materials, dye image-providing materials of the type which are originally non-diffusible but release a diffusible dye by the cleavage thereof after undergoing a redox reaction with the oxidation product of a developing agent (hereinafter, dye image-providing materials of this type are referred to as DRR compounds) are preferred.

Specific examples of DRR compounds are, in addition to those described in the above-indicated patents or patent applications, magenta dye image-forming materials such as 1-hydroxy-2-tetramethylenesulfamoyl-4-[3'-methyl-4'-(2''-hydroxy-4''-methyl-5''-hexadecyloxyphenylsulfamoyl)phenylazo]naphthalene and yellow dye-forming materials such as 1-phenyl-3-cyano-4-{3'-[2''-hydroxy-4''-methyl-5''-(2''',4'''-di-t-pentylphenoxyacetamido)phenylsulfamoyl]phenylazo}-5-pyrazolone.

Where DRR compounds are used in this invention, any silver halide developing agents which can cross-oxidize these compounds can be employed in this invention. Such developing agents may be incorporated in alkaline processing compositions (processing elements) or in appropriate layers of photo-sensitive elements. Examples of developing agents which can be used in this invention are hydroquinone and aminophenols such as N-methyl-aminophenol, 1-phenyl-3-pyrazolidone, 1-phenyl-4,4-dimethyl-3-pyrazolidone, 1-phenyl-4-methyl-4-hydroxymethyl-3-pyrazolidone, N,N-diethyl-p-phenylenediamine, 3-methyl-N,N-diethyl-p-phenylenediamine, 3-methoxy-N-ethoxy-p-phenylenediamine, etc. Of these developing agents, the use of black-and-white developing agents having the property of reducing the formation of stain in the image-receiving layers (mordant layers) is particularly preferred.

In the practice of this invention, when the so-called ordinary silver halide emulsions which undergo development depending on the amount of exposure are used with DRR compounds, the transferred image forms a negative image and the remaining image forms a positive image. On the other hand, when so-called direct reversal silver halide emulsions which are developed at the unexposed regions (e.g., internal latent image type silver halide emulsions or solarization type silver halide emulsions) are used, a positive image is obtained at the image-receiving layer of the film unit.

The above-described solarization type silver halide emulsions used preferably in this invention are described in, for example, C. E. K. Mees, *The Theory of the Photographic Process,* pp. 261–297, Macmillan Co., New York (1942). Processes for preparing solarization type silver halide emulsions are described in, for example, British Pat. Nos. 443,245 and 462,730 and U.S. Pat. Nos. 2,005,837, 2,541,472, 3,367,778, 3,501,305, 3,501,306 and 3,501,307.

Internal latent image type direct positive silver halide emulsions which can be used advantageously in this invention are also described in U.S. Patents described above.

By developing direct reversal photographic silver halide emulsions, after imagewise exposure, in the presence of a fogging agent or by fogging the direct reversal photographic silver halide emulsions using overall exposure (the overall exposure may be a short exposure under high illumination, that is, an exposure shorter than $10^{-2}$ second, or may be a long exposure under low illumination) and surface development processing after imagewise exposure, direct positive images can be obtained. However, it is preferred to use a fogging agent since the degree of fogging can be more easily controlled. The fogging agent may be incorporated in the photographic material or in the developer but the fogging agent preferably is incorporated in the photographic material. Typical examples of fogging agents for this type of silver halide emulsion are hydrazines as described in U.S. Pat. Nos. 2,588,982 and 2,568,785; hydrazide and hydrazone as described in U.S. Pat. No. 3,227,552; the quaternary salt compounds as described in British Pat. No. 1,283,835, Japanese Patent Publication No. 38,164/74, and U.S. Pat. Nos. 3,734,738, 3,719,494 and 3,615,615; and acylhydrazinophenylthiourea compounds as described in U.S. Pat. No. 3,615,615.

The amount of the fogging agent used in this case can be varied over a wide range depending on the desired purpose. Where the fogging agent is used in a photographic material, the amount of the fogging agent will depend upon the kind of fogging agent used but generally is about 0.1 mg to about 1,500 mg per mol of silver, preferably 0.5 mg to 700 mg per mol of silver.

Where the fogging agent is incorporated in a developer, the amount of the fogging agent generally is about 0.05 to about 5 g, preferably from 0.1 to 1 g, per liter of the developer.

Where the fogging agent is incorporated in a layer of a photographic material, the fogging agent is preferably non-diffusible. The fogging agent can be rendered non-diffusible by bonding a ballast group usually used for couplers to the fogging agent.

Furthermore, transferred positive images can be obtained using the DIR reversal silver halide emulsion system as described in U.S. Pat. Nos. 3,227,551, 3,227,554 and 3,364,002 or the reversal silver halide emulsion system using solution physical development as described in British Pat. No. 904,364. A series of processes for obtaining color diffusion transfer photographic images are described in U.S. Pat. Nos. 3,227,550 and 3,227,552 and British Pat. No. 1,330,524.

Typical examples of color developing agents which can be used in the case of using diffusible dye releasing couplers in this invention are the para-phenylenediamine derivatives described in U.S. Pat. Nos. 3,227,552, 2,559,643 and 3,813,244. Furthermore, the p-aminophenol derivatives as described in U.S. Pat. No. 3,765,886 may be advantageously used in this invention. Such a color developing agent is preferably incorporated in an alklaine developing composition contained in a rupturable container. The color developing agent may be incorporated in a layer additionally formed in the negative portion of the film unit or may be incorporated in a silver halide emulsion layer.

The photosensitive element used in this invention includes a support which does not undergo large dimensional deformation during processing. Examples of such supports are cellulose acetate films, polystyrene films, polyethylene terephthalate films, polycarbonate films, etc., which are used for ordinary photographic materials. Other effective supports are papers and papers laminated with a polymer such as polyethylene which is water impermeable.

The processing composition used in this invention is a liquid processing composition containing the processing components necessary for the development of silver halide emulsions and for the formation of dye images by diffusion transfer. The main solvent of the liquid processing composition is water and it may also contain a hydrophilic solvent such as methanol and methyl Cellosolve. The liquid processing composition further contains a sufficient amount of alkali for maintaining the necessary pH for development of the silver halide emulsion layers and neutralizing acids (e.g., hydrohalic acids such as hydrobromic acid and carboxylic acids such as acetic acid) formed during the steps of development and dye image formation. Examples of alkalis which can be used for the purpose are alkali metal hydroxides, alkaline earth metal hydroxides, or amines such as lithium hydroxide, sodium hydroxide, potassium hydroxide, a dispersion of calcium hydroxide, tetramethylammonium hydroxide, sodium carbonate, sodium tertiary phosphates, diethylamine, etc. It is preferred that the liquid processing composition contain an alkali metal hydroxide at a concentration capable of maintaining the pH thereof above about 12, particularly above about 14 at room temperature.

The liquid processing composition, most preferably, also contains a hydrophilic polymer of a high molecular weight, such as polyvinyl alcohol, hydroxyethylcellulose, sodium carboxymethylcellulose, etc. The polymer thus incorporated in the liquid processing solution not only imparts to the liquid processing solution a viscosity in excess of 1 poise, preferably 500 or 600 to 1,000 poises, at room temperature which facilitates the uniform spreading of the liquid processing composition at development, but also forms a non-fluid film when the liquid processing composition is concentrated by the transfer of the aqueous solvent into the photosensitive element and the image-receiving element during the process of development, which assists to integrate the film unit after processing. The polymer film helps, after the formation of dye images by diffusion transfer has been substantially finished, to prevent a change in the color images by suppressing further transfer of coloring components into the image-receiving element.

Furthermore, as the case may be, the liquid processing composition used in this invention advantageously can contain a light absorbent such as titanium dioxide, carbon black, a pH indicating dye, etc., or desensitizers as described in U.S. Pat. No. 3,579,333 for preventing the silver halide emulsion layers from being fogged by external light during processing. Moreover, a development inhibitor such as benzotriazole, etc., may also be incorporated in the liquid processing composition.

The processing composition described above preferably is retained in a rupturable container as described in U.S. Pat. Nos. 2,543,181, 2,643,886, 2,653,732, 2,723,051, 3,056,491, 3,056,492 and 3,152,515.

The photographic film unit of this invention, which is constructed such that it can be processed by passing the film unit through a pair of juxtaposed pressing members, includes the following elements:

(1) a photosensitive element;

(2) an image-receiving element having a layer containing the polymeric mordant of this invention; and (3) a means for releasing an alkaline processing composition in the film unit, such as, for example, a rupturable container containing a silver halide developer.

The photosensitive element of the film unit described above is, after imagewise exposure, processed generally by spreading the liquid alkaline processing composition between the photosensitive element and the image-receiving element while they are superimposed in a face-to-face relation. In this case, the image-receiving element may be separated from the photosensitive element after the dye image transfer is completed or the film unit may be constructed such that the color images are observed without separating the image-receiving element as is described in U.S. Pat. No. 3,415,645.

In another embodiment, the image-receiving element in the film unit described above may be integrated with the support and the silver halide photographic emulsion layers. For example, a photosensitive element prepared by coating on a transparent support, an image-receiving layer, a substantially opaque light-reflecting layer (e.g., a titanium dioxide-containing layer and a carbon black-containing layer), and a photosensitive layer comprising a single or a plurality of silver halide photographic emulsion layers, as is described in Belgian Pat. No. 757,960. After imagewise exposure, the photosensitive element is superposed on an opaque cover sheet (having associated therewith the neutralization system) in a face-to-face relationship and then the processing composition is spread between them.

Another embodiment of a superposed integrated type of film unit is disclosed in Belgian Pat. No. 757,959. In this embodiment, an image-receiving layer, a substantially opaque light-reflecting layer (e.g., a titanium dioxide layer and a carbon black layer as described above), and a single or a plurality of photosensitive silver halide emulsion layers are coated on a transparent support and then a transparent cover sheet (having associated therewith the neutralization system) is superposed on the photosensitive layer in a face-to-face relationship. A rupturable container retaining a liquid alkaline processing composition including an opacifying agent (e.g., carbon black) is disposed close to the uppermost layer of the photosensitive silver halide emulsion layers and the transparent top cover sheet described above. The film unit having such a configuration is imagewise exposed through the transparent cover sheet in a camera and then the container retaining the liquid alkaline processing composition is ruptured by a pressing means on removal of the film unit from the camera, whereby the liquid alkaline processing composition (containing an opacifying agent) is spread between the photosensitive layer and the cover sheet. Thus, the film unit is light-shielded and the development proceeds.

Furthermore, other useful integrated embodiments wherein DRR compounds or diffusible dye releasing couplers can be used in this invention are described in U.S. Pat. Nos. 3,415,644, 3,415,645, 3,415,646, 3,647,487 and 3,635,707 and German Patent Application (OLS) No. 2,426,980.

The mordanting layer containing a polymeric mordant having the unit represented by the formula (I) and acid processed gelatin causes less haze in the image formed after processing and provides the superior image having a high $D_{max}$ just after (for example, 1 hour after) processing. Furthermore, the mordanting layer according to the present invention does not become cloudy in contact with the processing solution and causes less damage to the image.

The present invention is explained in greater detail by reference to the following examples. Unless otherwise indicated, all parts, percents, ratios, etc., are by weight.

COMPARISON EXAMPLE 1

A photosensitive sheet was prepared by coating on a transparent polyester support the following layers successively:

(1) A mordanting layer containing 3.0 g/m$^2$ of a mordant having the following formula:

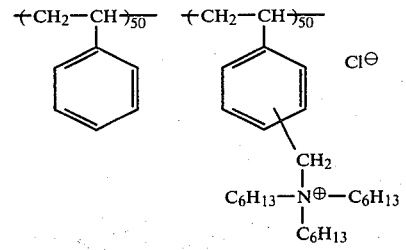

(Viscosity of a 25% by weight ethanol solution of the mordant was about 69 cp at 40° C.) and 3.0 g/m$^2$ of lime processed gelatin (having an isoelectric point of 4.8).

(2) A white reflecting layer containing 20 g/m$^2$ of titanium oxide and 2.0 g/m$^2$ of gelatin.

(3) A light-shielding layer containing 2.70 g/m² of carbon black and 2.70 g/m² of gelatin.

(4) A layer containing 0.50 g/m² of a cyan dye-providing material having the structure shown below:

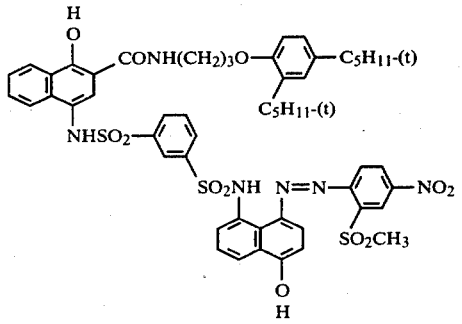

0.25 g/m² of diethyllaurylamide, and 1.14 g/m² of gelatin.

(5) A layer containing a red-sensitive internal latent image type direct reversal silver iodobromide emulsion (halogen composition of the silver halide: 2 mol% iodine) at a coverage of 1.9 g/m² of silver and a coverage of 1.4 g/m² of gelatin, a fogging agent having the structure:

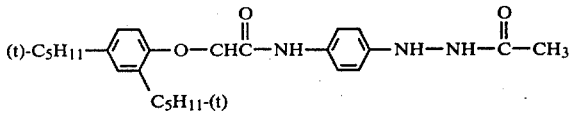

at a coverage of 0.028 g/m², and sodium dodecylhydroquinone-sulfonate at a coverage of 0.13 g/m².

(6) A layer containing 2.6 g/m² of gelatin and 1.0 g/m² of 2,5-dioctylhydroquinone.

(7) A layer containing 0.45 g/m² of a magenta dye-providing material having the structure shown below:

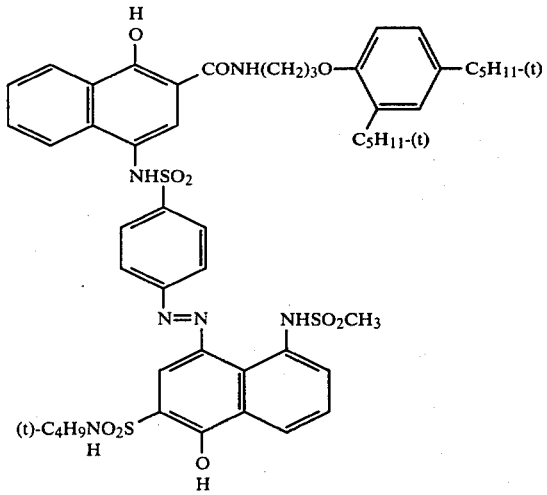

0.10 g/m² of diethyllaurylamide, 0.0074 g/m² of 2,5-di-t-butylhydroquinone, and 0.76 g/m² of gelatin.

(8) A layer containing a green-sensitive internal latent image type direct reversal silver iodobromide emulsion (halogen composition of the silver iodobromide: 2 mol% iodine) at coverages of 1.4 g/m² of silver and 1.0 g/m² of gelatin, the fogging agent as used in Layer (5) at a coverage of 0.024 g/m², and sodium dodecylhydroquinonesulfonate at a coverage of 0.11 g/m².

(9) A layer containing 2.6 g/m² of gelatin and 1.0 g/m² of 2,5-dioctylhydroquinone.

(10) A layer containing 0.78 g/m² of a yellow dye-providing material having the structure shown below:

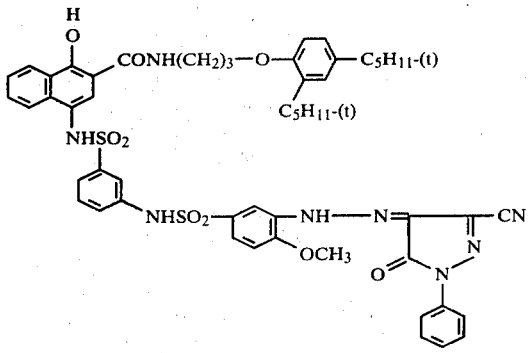

0.16 g/m² of diethyllaurylamide, 0.012 g/m² of 2,5-di-t-butylhydroquinone, and 0.78 g/m² of gelatin.

(11) A layer containing a blue-sensitive internal latent image type direct reversal silver iodobromide emulsion (halogen composition of silver iodobromide: 2 mol% iodine) at coverages of 2.2 g/m² of silver and 1.7 g/m² of gelatin, the fogging agent as used in Layer (5) at a coverage of 0.020 g/m² and sodium dodecylhydroquinonesulfonate at a coverage of 0.094 g/m².

(12) A layer containing 0.94 g/m² of gelatin.

| Processing Solution | |
|---|---|
| 1-Phenyl-4-methyl-4-hydroxymethyl-3-pyrazolidinone | 10 g |
| Methylhydroquinone | 0.18 g |
| 5-Methylbenzotriazole | 4.0 g |
| Sodium Sulfite (anhydrous) | 1.0 g |
| Sodium Carboxymethylcellulose | 40.0 g |
| Carbon Black | 150 g |
| Potassium Hydroxide (28% aq. soln.) | 200 ml |
| Water | 550 ml |

Cover Sheet

A cover sheet was prepared by coating on a transparent polyester support the following layers successively:

(1) A layer containing 22 g/m² of a copolymer of acrylic acid and butyl acrylate (80:20 by weight ratio) (Viscosity of a 25% by weight water-acetone mixed solution was about 4,000 cp) and 0.44 g/m² of 1,4-bis(2,3'-epoxypropoxy) butane.

(2) A layer containing 3.8 g/m² of acetyl cellulose (100 g of which was hydrolyzed to form 39.4 g of acetyl group), 0.2 g/m² of poly(styrene-maleic anhydride) (ratio: styrene:maleic anhydride=about 60:40; molecular weight: about 50,000) and 0.115 g/m² of 5-(β-cyanoethylthio)-1-phenyltetrazole.

(3) A layer containing 2.5 g/m² of a copolymer latex of vinylidene chloride, methyl acrylate and acrylic acid (85:12:3 by weight ratio) and 0.05 g/m² of a latex of polymethylmethacrylate (particle size: 1 to 3μ).

COMPARISON EXAMPLE 2

Comparison Example 1 was repeated except for using a mordanting layer containing 3.0 g/m² of a homopolymeric mordant having the following formula:

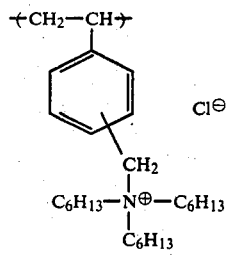

(Viscosity of a 25% by weight ethanol solution of the mordant was about 136 cp at 40° C.) and 3.0 g/m$^2$ of lime processed gelatin (isoelectric point: 4.8) in place of Layer (1).

EXAMPLE 1

Comparison Example 1 was repeated except for using a mordanting layer containing 3.0 g/m$^2$ of the homopolymeric mordant used in Comparison Example 2, (viscosity of a 25% by weight ethanol solution of the mordant was about 136 cp at 40° C.) and 3.0 g/m$^2$ of acid processed gelatin (isoelectric point: 7.1) in place of Layer (1).

Processing Procedure

The cover sheet described above was superposed on the photosensitive sheet described above and after exposing to a color test chart through the cover sheet side, the processing solution described above was spread between both sheets at a thickness of 85 microns using a press roller. The processing was carried out at 25° C. One hour after the processing and 8 days after the processing, the yellow density ($D^B$), magenta density ($D^G$) and cyan density ($D^R$) of the color images formed in the image-receiving layer were measured through the transparent support of the photosensitive sheet using a Macbeth reflection densitometer. The results obtained are shown in Table 1 below.

TABLE 1

| | | Maximum Density | | | Minimum Density | | |
|---|---|---|---|---|---|---|---|
| | | $D^B$ max | $D^G$ max | $D^R$ max | $D^B$ min | $D^G$ min | $D^R$ min |
| Comparison Example 1 | 1 hour | 1.78 | 1.78 | 1.80 | 0.23 | 0.20 | 0.34 |
| | 8 days | 1.86 | 2.15 | 2.15 | 0.27 | 0.22 | 0.36 |
| | ΔD | 0.08 | 0.37 | 0.35 | 0.04 | 0.02 | 0.02 |
| Comparison Example 2 | 1 hour | 1.56 | 1.58 | 1.60 | 0.21 | 0.22 | 0.30 |
| | 8 days | 1.66 | 2.06 | 2.05 | 0.22 | 0.24 | 0.32 |
| | ΔD | 0.10 | 0.48 | 0.45 | 0.01 | 0.02 | 0.02 |
| Example 1 | 1 hour | 1.70 | 2.02 | 2.10 | 0.22 | 0.21 | 0.34 |
| | 8 days | 1.76 | 2.15 | 2.20 | 0.24 | 0.23 | 0.35 |
| | ΔD | 0.06 | 0.13 | 0.10 | 0.02 | 0.02 | 0.01 |

ΔD is the difference in density between 1 hour and after 8 days.

As is apparent from the results shown in Table 1, $D_{max}$ at one hour after the processing in Comparison Examples 1 and 2 is low but the densities in three examples reach to almost same value in 8 days. The transferred images formed in Comparison Examples 1 and 2 one hour after the processing are accompanied by haze in all image areas which adversely affects the color saturation and the image quality is poor.

On the other hand, in the sample of Example 1, the occurrence of haze is small and the image formed 1 hour after the processing exhibits high color saturation and desirable image quality is obtained.

EXAMPLE 2

Each of the mordanting layers described in Comparison Examples 1 and 2 and Example 1 was coated on a transparent polyester support as described in Example 1 and dried to form film samples (Sample 11, Sample 12 and Sample 13). The transmittance of the sample was measured using a Hitachi autorecording spectrophotometer type 323 (manufactured by Hitachi Seisakusho). Also, the transmittance of the sample was measured when the sample was wetted with water and when the sample was wetted with a 5% by weight aqueous solution of sodium alkylbenzenesulfonate (carbon number in the alkyl group is 12 to 13). The results are shown in Table 2 below.

The sodium alkylbenzenesulfonate was used in this context as a typical example for an anionic compound. From the results shown in Table 2, it is apparent that the mordanting layer of Example 1 hardly becomes cloudy when the layer is wetted with water or an anionic compound.

TABLE 2

| | Transmittance of Mordanting Layer (Measured at 420 nm wavelength) | | |
|---|---|---|---|
| | Dried Layer | Layer Wetted with Water | Layer Wetted with 5% by Weight Aqueous Solution of Sodium Alkylbenzenesulfonate |
| Sample 11 (Comparison Example 1) | 1.090 | 0.259 | 0.395 |
| Sample 12 (Comparison Example 2) | 1.230 | 0.352 | 0.413 |
| Sample 13 (Example 1) | 1.080 | 0.080 | 0.120 |

While the invention has been described in detail and with reference to specific embodiments thereof, it will be apparent to one skilled in the art that various changes and modifications can be made therein without departing from the spirit and scope thereof.

What is claimed is:

1. A photographic element comprising a support having thereon at least one layer containing acid processed gelatin having an isoelectric point of about 6.0 to 9.3 and a homopolymeric mordant containing a repeating unit represented by the following general formula (I):

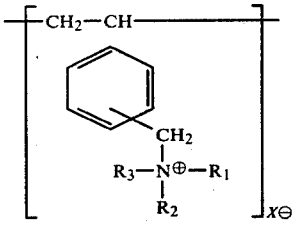

wherein $R_1$, $R_2$ and $R_3$, which may be the same or different, each represents an alkyl group and the total number of carbon atoms in $R_1$, $R_2$ and $R_3$ is 12 or more; and $X^{\ominus}$ represents an anion.

2. The photographic element of claim 1, wherein $R_1$, $R_2$ and $R_3$ are each an n-$C_6H_{13}$ group.

3. The photographic element of claim 1, wherein $R_1$, $R_2$ and $R_3$ are each an n-$C_5H_{11}$ group.

4. The photographic element of claim 1, wherein the acid processed gelatin has an isoelectric point of about 6.5 to 7.5.

5. The photographic element of claim 1, wherein said polymeric mordant is present in said layer in an amount of about 20 to 80% by weight based on the combined amount of acid processed gelatin and polymeric mordant.

6. The photographic element of claim 5, wherein said polymeric mordant is present in an amount of about 0.5 to 8 g/m$^2$.

7. An integrated photographic element for color diffusion transfer process comprising a transparent support having thereon the following layers:

(a) a mordant layer containing acid processed gelatin having an isoelectric point of about 6.0 to 9.3 and a homopolymeric mordant containing a repeating unit represented by the following formula (I):

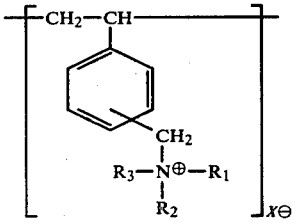

wherein $R_1$, $R_2$ and $R_3$, which may be the same or different, each represents an alkyl group and the total number of carbon atoms in $R_1$, $R_2$ and $R_3$ is 12 or more; and $X^{\ominus}$ represents an anion, (b) at least one light-sensitive silver halide emulsion layer associated with a dye image-providing material.

8. The integrated photographic element of claim 7, wherein $R_1$, $R_2$ and $R_3$ are each an n-$C_6H_{13}$ group.

9. The integrated photographic element of claim 7, wherein $R_1$, $R_2$ and $R_3$ are each an n-$C_5H_{11}$ group.

10. The integrated photographic element of claim 7, wherein the acid processed gelatin has an isoelectric point of about 6.5 to 7.5.

11. The integrated photographic element of claim 7, wherein said polymeric mordant is present in said layer in an amount of about 20 to 80% by weight based on the combined amount of acid processed gelatin and polymeric mordant.

12. The integrated photographic element of claim 7, wherein said polymeric mordant is present in an amount of about 0.5 to 8 g/m$^2$.

13. In an integrated photographic element for color diffusion transfer process comprising a transparent support having thereon a mordanting layer and a light-sensitive silver halide emulsion layer associated with a dye image-providing material, the improvement which comprises said mordanting layer containing acid processed gelatin having an isoelectric point of about 6.0 to 9.3 and a homopolymeric mordant containing a repeating unit represented by the following formula (I):

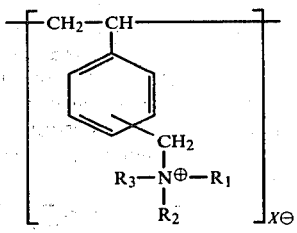

wherein $R_1$, $R_2$ and $R_3$, which may be the same or different, each represents an alkyl group and the total number of carbon atoms in $R_1$, $R_2$ and $R_3$ is 12 or more; and $X^{\ominus}$ represents an anion.

14. The integrated photographic element of claim 13, wherein the acid processed gelatin has an isoelectric point of about 6.5 to 7.5.

* * * * *